US012030539B2

(12) United States Patent
Jovenall et al.

(10) Patent No.: US 12,030,539 B2
(45) Date of Patent: Jul. 9, 2024

(54) DEVICES, SYSTEMS, AND METHODS RELATED TO TRACKING LOCATION OF OPERATOR CONTROL UNITS FOR LOCOMOTIVES

(71) Applicant: Cattron North America, Inc., Warren, OH (US)

(72) Inventors: Jeremy Jovenall, Mercer, PA (US); André Brousseau, Quebec (CA)

(73) Assignee: Cattron North America, Inc., Warren, OH (US)

( * ) Notice: Subject to any disclaimer, the term of this patent is extended or adjusted under 35 U.S.C. 154(b) by 354 days.

(21) Appl. No.: 17/688,102

(22) Filed: Mar. 7, 2022

(65) Prior Publication Data

US 2022/0185347 A1 Jun. 16, 2022

Related U.S. Application Data

(63) Continuation-in-part of application No. 17/361,004, filed on Jun. 28, 2021, now Pat. No. 11,926,353, which is a continuation-in-part of application No. 16/036,024, filed on Jul. 16, 2018, now Pat. No. 11,046,335, which is a continuation-in-part of application No. 14/615,573, filed on Feb. 6, 2015, now Pat. No. 10,023,210.

(Continued)

(51) Int. Cl.
*B61L 15/00* (2006.01)

(52) U.S. Cl.
CPC ..... *B61L 15/009* (2013.01); *B61L 15/0072* (2013.01)

(58) Field of Classification Search
CPC ..... B61L 15/009; B61L 15/0072; B61L 15/0027; B61L 3/127
See application file for complete search history.

(56) References Cited

U.S. PATENT DOCUMENTS 5,889,790 A 3/1999 Fukuda
6,222,484 B1 4/2001 Seiple et al.
(Continued)

FOREIGN PATENT DOCUMENTS

EP 1186904 A2 3/2002
WO WO-2021041921 A1 * 3/2021 ..... B60W 60/001

OTHER PUBLICATIONS

International Search Report and Written Opinion dated May 24, 2016 for PCT Application No. PCT/US2016/016687 filed Feb. 5, 2016 which claims priority to the instant application, 12 pages.
(Continued)

*Primary Examiner* — Donald J Wallace
(74) *Attorney, Agent, or Firm* — Harness, Dickey & Pierce, P.L.C.; Anthony G. Fussner

(57) ABSTRACT

According to various aspects, exemplary embodiments are disclosed of devices, systems, and methods related to tracking location of operator control units for locomotives. In exemplary embodiments, a system includes an operator control unit configured to receive one or more commands from an operator for controlling a locomotive. The operator control unit includes a receiver configured to receive geographical location information of the operator control unit. The system is configured to monitor a geographical location of the operator control unit.

27 Claims, 2 Drawing Sheets

Related U.S. Application Data

Figure 1:
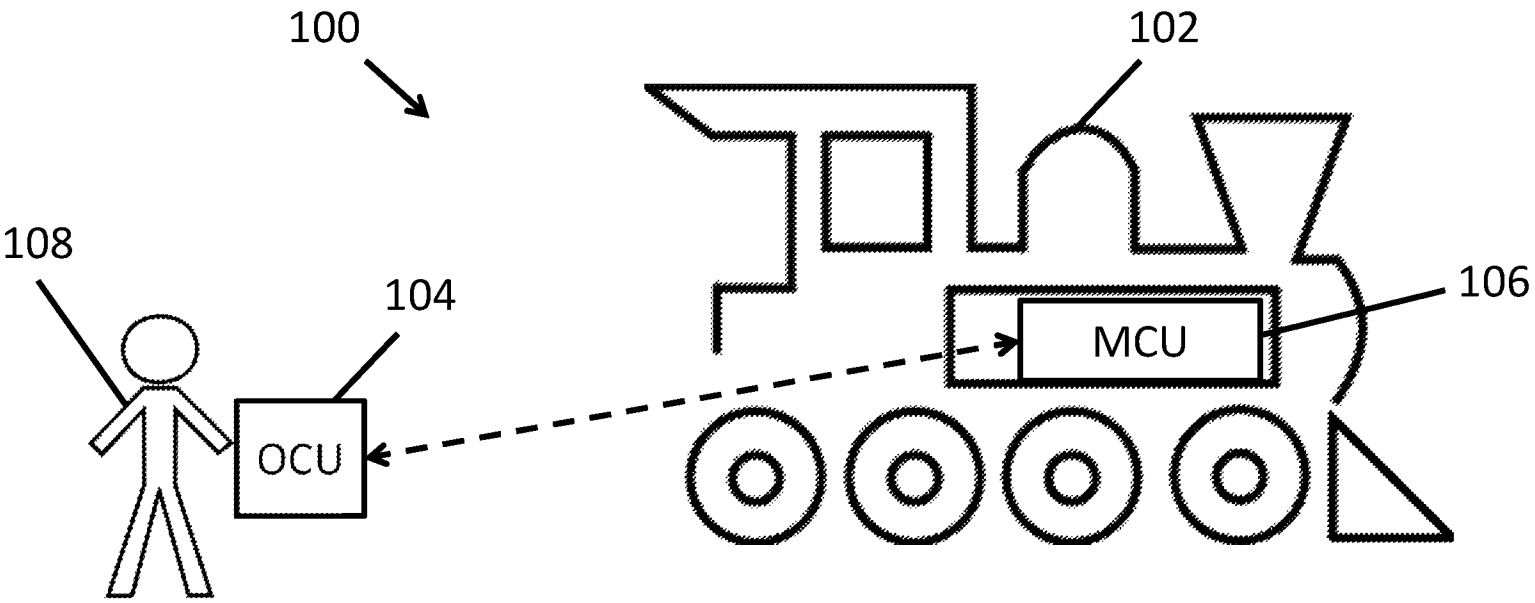

(60) Provisional application No. 63/160,228, filed on Mar. 12, 2021, provisional application No. 63/158,482, filed on Mar. 9, 2021.

(56) References Cited

U.S. PATENT DOCUMENTS

| | | | |
|---|---|---|---|
| 6,292,751 | B1 | 9/2001 | Frank |
| 6,853,890 | B1 | 2/2005 | Horst et al. |
| 7,239,943 | B2 | 7/2007 | Peltz |
| 7,529,201 | B2 | 5/2009 | Aiken, II et al. |
| 8,509,964 | B2 | 8/2013 | Ecton et al. |
| 11,046,335 | B2 | 6/2021 | Jovenall et al. |
| 2002/0059018 | A1 | 5/2002 | Brousseau |
| 2002/0146082 | A1 | 10/2002 | Horst |
| 2004/0104311 | A1 | 6/2004 | Fernandez |
| 2006/0015223 | A1 | 1/2006 | LeBlanc et al. |
| 2007/0069918 | A1 | 3/2007 | You |
| 2007/0150130 | A1 | 6/2007 | Welles et al. |
| 2009/0248223 | A1 | 10/2009 | Ecton et al. |
| 2010/0168941 | A1 | 7/2010 | Geiger |
| 2010/0277310 | A1 | 11/2010 | Imae |
| 2011/0251737 | A1 | 10/2011 | Ecton |
| 2013/0210460 | A1 | 8/2013 | Subramanian et al. |
| 2013/0311004 | A1 | 11/2013 | Okamura |
| 2016/0229434 | A1 | 8/2016 | Brousseau et al. |
| 2017/0148323 | A1 | 5/2017 | Shubs, Jr. |
| 2018/0075302 | A1* | 3/2018 | Udell ..... G06V 20/20 |
| 2018/0265107 | A1 | 9/2018 | Mayo |
| 2019/0340909 | A1* | 11/2019 | Nguyen ..... B25J 9/1676 |
| 2021/0348930 | A1* | 11/2021 | Johnson, Jr. ..... G08G 1/096811 |

OTHER PUBLICATIONS

Canadian Office Action dated Jun. 15, 2018 for Canadian Application No. 2,975,880 which claims priority to the parent application to the instant application, 4 pages.

European Search Report dated Feb. 23, 2018 for EP Application No. 16747311.5 which claims priority to the parent application to the instant application, 4 pages.

Nonfinal Office Action for U.S. Appl. No. 17/361,004, filed Jun. 28, 2021 that claims priority to the same parent application as the instant application; dated Aug. 24, 2023; 29 pages.

* cited by examiner

DEVICES, SYSTEMS, AND METHODS RELATED TO TRACKING LOCATION OF OPERATOR CONTROL UNITS FOR LOCOMOTIVES

CROSS-REFERENCE TO RELATED APPLICATIONS

This application claims priority to and the benefit of U.S. Provisional Patent Application No. 63/158,482 filed Mar. 9, 2021.

This application claims priority to and the benefit of U.S. Provisional Patent Application No. 63/160,228 filed Mar. 12, 2021.

This application is continuation-in-part of U.S. patent application Ser. No. 17/361,004 filed Jun. 28, 2021.

U.S. patent application Ser. No. 17/361,004 is a continuation of U.S. patent application Ser. No. 16/036,024 filed Jul. 16, 2018, which published as US2018/032700 on Nov. 15, 2018 and issued as U.S. Pat. No. 11,046,335 on Jun. 29, 2021.

U.S. patent application Ser. No. 16/036,024 is a continuation-in-part of U.S. patent application Ser. No. 14/615,573 filed Feb. 6, 2015, which issued as U.S. Pat. No. 10,023,210 on Jul. 17, 2018.

The entire disclosures of the above applications are incorporated herein by reference.

FIELD

The present disclosure generally relates to devices, systems, and methods related to tracking location of operator control units for locomotives.

BACKGROUND

This section provides background information related to the present disclosure which is not necessarily prior art.

A locomotive may include a machine control unit (MCU) configured to control one or more aspects of the locomotive, including starting, stopping, speed, braking, switching, etc. Operators may use an operator control unit (OCU) to control the locomotive. The operator control unit may send commands, instructions, etc. to the machine control unit via a wireless network to control the locomotive. In some configurations, the machine control unit may send messages back to the operator control unit to relay feedback and other messages.

DRAWINGS

The drawings described herein are for illustrative purposes only of selected embodiments and not all possible implementations and are not intended to limit the scope of the present disclosure.

Figure 2:
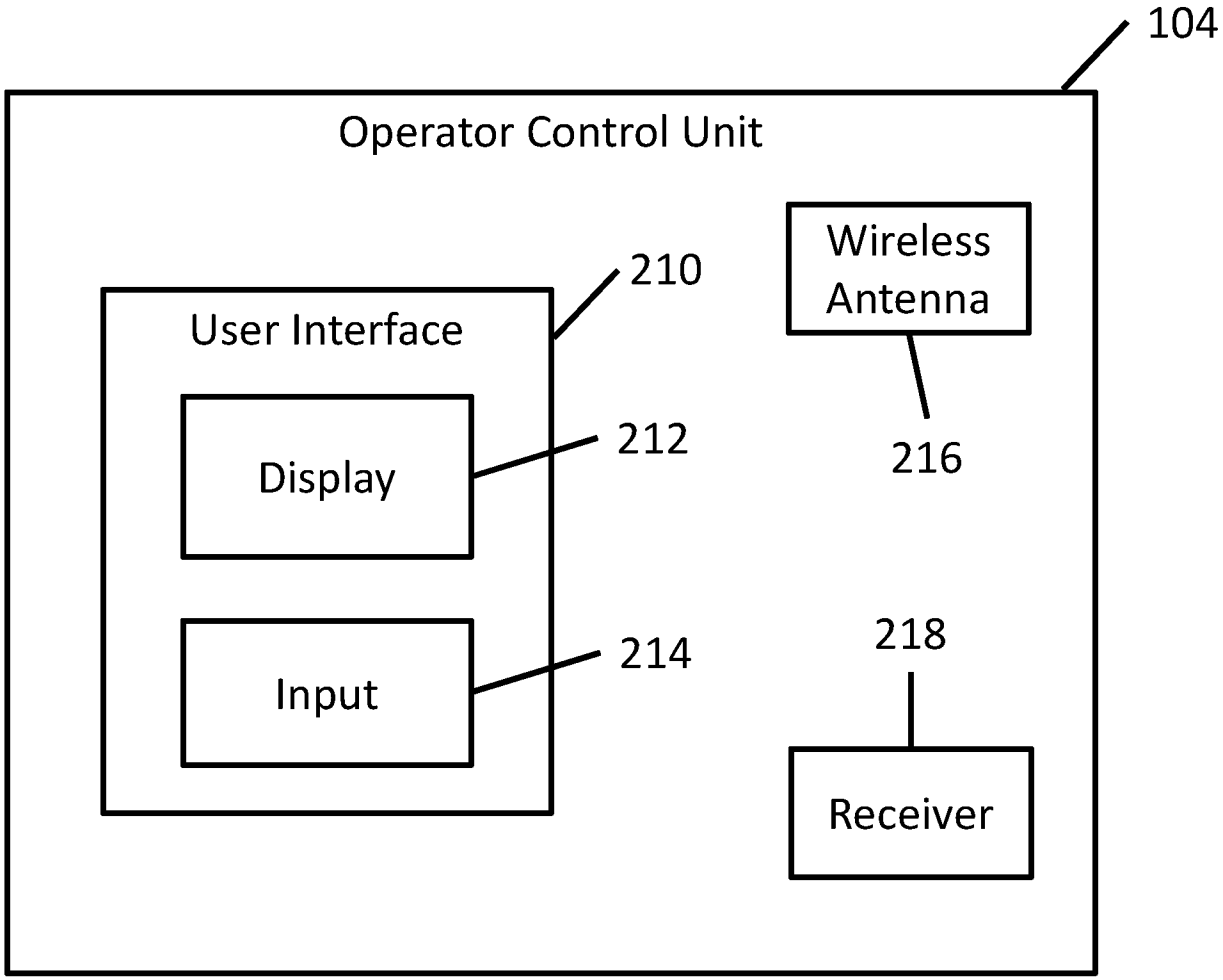

FIG. 1 is a block diagram of an example system for tracking location of an operator control unit for a locomotive; and FIG. 2 is another block diagram of the example operator control unit of FIG. 1.

Corresponding reference numerals indicate corresponding parts throughout the several views of the drawings.

DETAILED DESCRIPTION

Example embodiments will now be described more fully with reference to the accompanying drawings.

By adding location information (e.g., via a global navigation satellite system (GNSS) receiver, etc.) to an operator control unit (OCU) for a locomotive, a machine control unit (MCU) for the locomotive may be able to determine where the operator control unit is located. For example, the operator control unit may transmit the location of the OCU to the machine control unit located at the locomotive, through an existing wireless network channel (e.g., one or more radio frequency (RF) channels such as Wi-Fi, etc.). But forwarding operator control unit positional data to the machine control unit can be a challenge, due to the amount of data bytes that must be transferred to the MCU, etc. Existing RF communication channels and protocols may be fully used for transferring switch, command, etc. data from the operator control unit to the machine control unit, such that adding another RF communication channel would be complicated and expensive.

Accordingly, disclosed herein are exemplary embodiments of devices, systems, and methods related to tracking location of operator control units for locomotives, which may be used for providing hazardous walking condition alerting in rail yard applications. In exemplary embodiments, OCU location data is utilized to enhance operator safety in hazardous walking condition locations.

In an exemplary embodiment, an operator control unit includes a user interface configured to receive one or more commands from an operator for controlling a locomotive. The operator control unit also includes a receiver configured to receive location information of the operator control unit, and a wireless communication device. The wireless communication device is configured to transmit command data corresponding to the one or more commands and location data corresponding to the location information to a machine control unit onboard the locomotive.

In addition, the geographical location (e.g., GPS location, etc.) of the operator control unit may be monitored and compared to predefined hazardous walking condition locations to determine whether and when the operator control unit will enter a hazardous walking condition location. Prior to entry of the operator control unit into a hazardous walking condition location, a warning alert may be provided and/or a safe stop may be triggered and enforced. For example, an audible, visible, textual, and/or tactile alert may be generated by the operator control unit and/or other nearby equipment to warn the operator(s) prior to entry of the operator control unit into the hazardous walking condition location. As another example, a safe stop may be triggered and enforced to stop the locomotive and/or to stop a box car, rolling stock or other moving object on an adjacent track prior to entry of the operator control unit into a hazardous walking condition between the locomotive and the other moving object. As rail yard automation technology continues to expand, exemplary embodiments may be configured to include a dynamically updated process during which all stationary obstacles and rolling stock may be tracked.

In an exemplary embodiment, an operator control unit is configured with the capability of sending its geographic location through an RF telegram as GPS coordinates. The operator control unit may send the RF telegram as GPS coordinates to a machine control unit onboard the locomotive or other remote control locomotive (RCL) equipment. The machine control unit or other RCL equipment receives the GPS coordinates and is configured to monitor and compare the GPS location of the operator control unit to predefined hazardous walking condition locations to determine whether and when the operator control unit will enter a hazardous walking condition location. Prior to entry of the operator control unit into the hazardous walking condition location, the machine control unit or other RCL equipment may be configured to provide a warning alert and/or trigger and enforce a safe stop of the locomotive.

Advantageously, exemplary embodiments disclosed herein may therefore add a layer of safety for the users of operator control units and other RCL equipment, which may also be extended to benefit railroaders that use other devices in addition to, or as an alternative, to RCL equipment and operator control units. By providing reminders/warnings of hazardous walking condition locations as the operators approach (e.g., while walking towards, etc.) these hazardous locations and/or by triggering and enforcing safe stops, lives may be saved from these hazards posed to railroaders when walking along the tracks, etc.

Aspects of the present disclosure should not be limited to only operator control units, RCL equipment, and railroaders as exemplary embodiments disclosed herein may be extended to benefit other persons in addition to railroaders and/or that use other devices. As rail yard automation technology expands, the current definition of an operator control unit is expected to change. Accordingly, exemplary embodiments should not be limited to only those operator control units that fit under the current definition.

For example, exemplary embodiments may also include or be used with devices having less user control switches for manipulating locomotives and instead provide functionality that would either permit or deny rolling stock movement in the general location of the operator. In this example, hazardous walking condition alerting may provide an important addition to fall alert detection and rolling stock movement permission.

As another example, aspects of the present disclosure may also be used with and/or applicable to over the road (OTR) operations, e.g., where the RCL may be used if a one-person crew needs to deboard the locomotive for a variety of tasks while transporting the train over main track (out of yard). In an exemplary embodiment, an alert may be provided that includes a warning when an operator (based on the determined OCU geographical location) is approaching a location(s) where ground condition(s) could be hazardous, such as walking toward a trestle, steep embankment, etc. This type of alert would not stop movement, but would alert the operator to watch footing, which could be especially helpful in low visibility environments. In an example OTR operation, the alerting may include a one-time warning when communication to the MCU starts that weather conditions are hazardous based on an MCU link to weather reporting or local alerts provided by a railroad dispatcher.

Accordingly, exemplary embodiments may be configured to provide an alert, warning, and/or reminder (broadly, an alert) of hazardous walking condition locations to a person(s) (e.g., a railroader, operator, user, locomotive control person, engineer, rail yard coordinator, employee, etc.). For example, alerting may help a person(s) remember to remain vigilant. After receiving an alert, the person(s) may take action(s) to avoid or be more careful within the hazardous walking condition location.

In some embodiments, the wireless communication device or interface may automatically multiplex and change between different radio frequency (RF) channels when transmitting the command data and the location data to the machine control unit. For example, the wireless communication device could include a Wi-Fi or LTE interface. The wireless communication device may transmit the command data to the machine control unit via a first RF channel of the different RF channels, and to transmit the location data to the machine control unit via a second RF channel of the different RF channels. In some exemplary embodiments, the geographic (e.g., GPS, etc.) location data transmitted by the wireless communication device via the second one of the different RF channels may be used (e.g., by a machine control unit onboard a locomotive or other RCL equipment, etc.) for monitoring and comparing the geographic location of the operator control unit to predefined hazardous walking condition locations to determine whether and when the operator control unit will enter a hazardous walking condition location. Prior to entry of the operator control unit into a hazardous walking condition location, a warning alert may be provided and/or a safe stop may be triggered and enforced.

In an exemplary embodiment, static predefined areas could be determined through a manual site survey, where these areas are defined by creating geofences that are digitally stored in the MCU. In this example situation, the MCU would alert the OCU when the OCU location indicates that the OCU is crossing a geofence and entering a hazardous walking condition location defined by the geofence. In a more responsive embodiment, the geofence data could be sent to the OCU from the MCU when the OCU is paired to the MCU during start of shift procedures. The latter approach would permit the OCU to generate the alert locally and independently of the MCU, which would eliminate any delay associated to the OCU sending its location data to the MCU in multiple packets and would eliminate the delay associated to the RF packet transmissions between the devices when RF communication is degraded.

In an exemplary embodiment, the MCU is initially provided an electronic geofence map uploaded to the MCU, and the MCU will monitor OCU location to trigger the hazardous walking condition alarm or safe stop. Another exemplary embodiment may load an electronic geofence map to the OCU during pairing so that the OCU can either have a redundant source of the alarm generated by the MCU and locally to the OCU or rely only on the local source. Within the vision of rail automation in the yard, when rolling stock locations are constantly monitored, the electronic geofence map may be dynamically updated to the devices (MCU, OCU, or both) and not excluding Industrial Internet of Things (IIoT) protective devices by the local monitoring server through the RF Gateway.

In an exemplary embodiment, an MCU onboard the locomotive may send an alert command to the OCU so that the OCU will then generate an alert for a hazardous walking condition area. Additionally, or alternatively, the MCU onboard the locomotive may trigger and enforce a safe stop prior to entry of the locomotive into the hazardous walking condition area. These MCU options may depend on end user preference for each hazardous walking condition area, which may be controlled by a tag or other attribute associated with each geofence zone in the digital map, by an end user configuration file, and/or for a rail yard automation vision, by severity as determined by the local monitoring server through the RF Gateway.

Alternatively, or in addition, the operator control unit may include a first wireless radio configured to transmit command data corresponding to the one or more commands to a machine control unit on the locomotive, and a second wireless radio configured to transmit location data corresponding to the location information to the machine control unit. In some cases, the wireless communication device or interface (which may include multiple wireless radios) can transmit the received location data directly to the machine control unit onboard the locomotive to allow the machine control unit to determine a location of the operator control unit.

In addition to the machine control unit determining the location of the operator control unit, the machine control unit may also be configured to be operable for monitoring and comparing the location of the operator control unit to one or more predefined hazardous walking condition locations to determine whether and when the operator control unit will enter a hazardous walking condition location. Prior to entry of the operator control unit into the hazardous walking condition location, the machine control unit may enforce a safe stop of the locomotive and/or provide a warning alert to the operator. For example, after the machine control unit has determined that the operator control unit is approaching a hazardous walking condition location, the machine control unit may send an alert command, instructions, etc. via a wireless network (e.g., RF, Wi-Fi, LTE, Bluetooth, other suitable wireless network, etc.) to the operator control unit. In response to receiving the alert command from the machine control unit, an alert device of the operator control unit may provide an alert (e.g., audible and/or vibration alert, etc.) to notify the operator of the approaching hazardous walking condition location prior to entry into the hazardous walking condition location.

The operator control unit may be any suitable controller for sending commands to control a locomotive (e.g., train, engine, etc.), including a remote control, a locomotive control, a locomotive operation device, etc. The operator control unit may send any suitable commands, including switch commands, brake commands, speed commands, direction, bell, horn, headlight, sand, status requests, motion detection, tilt detection, pitch and catch, low battery voltage condition, fault detection, etc. Accordingly, the operator control unit may allow an operator (e.g., user, locomotive control person, engineer, rail yard coordinator, etc.) to control movement and/or other functions of the locomotive.

The operator control unit may include any suitable user interface for receiving commands and/or other input from an operator, including a touch screen interface, keypad, buttons, etc. The operator control unit may include a display, lights, light emitting diodes (LEDs), indicators, etc. for displaying information to the operator. The operator control unit (OCU) may include one or more processors, memory (e.g., one or more hard disks, flash memory, solid state memory, random access memory, read only memory, etc.), etc. configured to operate the OCU and store information related to operation of the OCU. For example, predefined hazardous walking condition locations may be stored within memory of the operator control unit and/or predefined hazardous walking condition locations may be stored within memory of the machine control unit.

The operator control unit may include one or more wireless communication devices, antennas, etc. for wireless communication. The operator control unit may also include any suitable receiver element, device, etc. for determining a location of the OCU, including a GNSS antenna (e.g., a global positioning system (GPS) antenna, etc.), a real-time locating system (RTLS) receiver or transceiver, etc. In some embodiments, the operator control unit may include an audible and/or vibration alert device to notify an operator of one or more different conditions, e.g., an approaching hazardous walking condition location, etc.

The operator control unit may control the locomotive via wireless signals transmitted to a machine control unit located at the locomotive. The machine control unit may be any suitable controller for controlling operation of the locomotive and may be coupled to one or more systems of the locomotive including a braking system, an engine and/or driving system, a switching system, a navigational system, etc. The machine control unit may be mounted onboard the locomotive, included inside the locomotive, attached to the locomotive, incorporated into the locomotive, etc. In some embodiments, the machine control unit may not include any portions that are not located onboard the locomotive and/or other parts of the train.

As stated above, the operator control unit (OCU) may transmit commands, data, messages, signals, etc. to the machine control unit via a wireless network. The wireless network may be any suitable wireless network, including RF, Wi-Fi, Bluetooth, etc. In exemplary embodiments, the operator control unit may transmit (e.g., send, etc.) and receive signals from the machine control unit via two-way communication between the OCU and the MCU. In some embodiments, the operator control unit may send command signals only to the machine control unit, may not send command signals to any central station or location not located at the locomotive, etc. In some embodiments, the operator control unit may transmit (e.g., send, etc.) signals to the machine control unit (MCU) at least initially via one-way communication, which one-way communication may be updated to two-way communication.

Command data may be transmitted from the operator control unit to the machine control unit via any suitable protocol, including RF channels, etc. For example, the command data may be transmitted in one or more messages which may be included in one or more RF packets and transmitted on an RF channel. Existing protocols may use substantially all of the bandwidth of an RF channel for transmitting the command data. Some embodiments of the present disclosure may add a GNSS element to the operator control unit and transmit the OCU's geographical location through the existing RF channel back to the locomotive's machine control unit, thus allowing the MCU to know where the OCU and its operator are geographically located. In such embodiments, the system (e.g., the OCU, MCU, and/or other equipment, etc.) may be configured to monitor and compare the OCU's geographical location to predefined hazardous walking condition areas and to provide a warning alert and/or enforce a safe stop prior to entering or entry into the hazardous walking condition area.

In order to use an existing RF channel, in some embodiments the operator control unit may wait until a same command message is sent for a short period of time (e.g., repeated more than a predetermined number of times in succession, etc.) and then send GPS positional information instead of the command message. For example, if the operator control unit does not have any switch changes for a short period, the OCU may send a location data message to the MCU during one or more packets, windows, etc. of the RF channel, instead of continuing to transmit the same command data message.

Thereafter, the OCU may resume sending the same command data message, continue sending the location data message until a new command data message is generated, etc. This may allow the operator control unit to transmit location data messages without having to add another RF communication channel, while still preserving the existing command data messages. Thus, in some embodiments, location data and command data may be transmitted via the same RF channel.

As described above, in some embodiments, the operator control unit may modify the protocol such that the OCU can transmit switch, command, etc. data and OCU positional data. The operator control unit may send location data (e.g., GPS coordinates, other positional data, etc.) only after a command data message has remained stable long enough for the machine control unit to have received it. For example, a command data message may need to remain constant for a certain time period threshold, be retransmitted a predetermined number of times, etc. in order to provide sufficient certainty that the command data message will successfully reach the machine control unit.

Thereafter, the operator control unit may transmit a location data message instead of continuing to transmit the command data message beyond the period of time necessary to provide a stable transmission of the command data message. The operator control unit may transmit the location data message for a long enough period to provide a stable transmission of the location data message to the machine control unit, and then continue transmitting the location data message, retransmit the command data message, wait for a new command data message, etc.

In some embodiments, the operator control unit and the machine control unit may have two-way communications. The machine control unit may inform the operator control unit whether or not the last packet the OCU sent to the MCU was received successfully (e.g., send an acknowledgment, confirmation, etc.). With this information, the operator control unit may more quickly start sending positional packets, which may reduce the duration for which an unchanged command packet has to be retransmitted and may increase the number of positional packets transmitted.

For example, the operator control unit may be configured to transmit command data until an acknowledgment is received from the machine control unit indicating the last OCU message was received, and then to transmit location data. Accordingly, an OCU may be configured to transition from sending command data to sending location data in the event an acknowledgment is received from the MCU of a successful command data message transmission.

In some embodiments, the location data may include absolute position data for the operator control unit. For example, the location data may include a full latitude and longitude of the operator control unit, full GPS signal information, etc. Alternatively, or in addition, the location data may include relative position data for the operator control unit. The relative position data may provide a position of the operator control unit relative to a previously transmitted absolute position of the operator control unit, a previously transmitted relative position of the OCU, etc.

For example, the operator control unit may first transmit a location data message including an absolute position of the OCU. Next, the operator control unit may transmit a location data message including a relative position data indicative of a relative change in position from the previous absolute position data. The operator control unit may then transmit another location data message relative to the prior relative position, indicating a change in position from the prior relative position.

Accordingly, the operator control unit may first transmit (or occasionally transmit, etc.) an absolute position of the OCU, followed by one or more transmissions of relative OCU position. The relative position data may include less data (e.g., fewer bytes, etc.) than the absolute position data, such that transmitting relative position data requires less bandwidth, less time, fewer packets, etc. as compared to transmitting absolute position data. The location data messages may be transmitted at any desired interval, which may be the same or different between each transmission.

In some embodiments, the operator control unit and machine control unit may include infrared transceivers. The operator control unit may link with the machine control unit via an OCU assignment session. During this operator control unit assignment session, the OCU and the machine control unit may exchange information using their infrared transceivers. The reference absolute GPS position may be exchanged between the machine control unit and the operator control unit over the infrared transceiver communication link during the OCU assignment session.

In some embodiments, the operator control unit may break up the location data into multiple RF packets that are transmitted separately, in succession, etc. The machine control unit may then receive the multiple RF packets and reassemble them. Accordingly, the operator control unit may be able to send location data in smaller windows, which may provide less interference with the existing command data messages, while the machine control unit can still combine the packets to receive the full location data message.

The operator control unit may also include other suitable features, including a tilt sensor, etc. For example, a tilt sensor may be used to detect a change in orientation of the operator control unit. The change in orientation may be indicative of a possibility of a fall of the operator carrying the control unit. For example, if the operator carrying the OCU falls and the tilt sensor detects the change in orientation when the operator drops the OCU, is horizontal to the ground, etc., the OCU may transmit this information to the machine control unit and the MCU will know a location of the fallen operator.

With reference to the figures, FIG. 1 illustrates an example system 100 according to some aspects of the present disclosure. The system 100 includes a locomotive 102 having a machine control unit 106, which may include any suitable machine control unit as described herein.

The system 100 also includes an operator control unit 104, which may be any suitable operator control unit as described herein. The operator control unit 104 may receive commands from an operator 108 and transmit the commands to the machine control unit 106 for controlling the locomotive 102.

As shown in FIG. 1, the operator control unit 104 may allow an operator 108 to control the locomotive 102, send commands to the locomotive 102, etc., while the operator 108 is remote from the locomotive 102. Accordingly, the operator 108 may control the locomotive 102 from a variety of suitable positions. In some embodiments, the operator 108 may be required to be within a threshold distance of the locomotive 102, such as in sight of the locomotive 102, within a wireless network signal strength range, etc.

Adding location information to the operator control unit 104 allows the machine control unit 106 to know where the operator control unit 104 and the operator 108 are located. This location information may be helpful in locating the operator 108 in the event of a detected operator fall, troubleshooting RF communication between the operator control unit 104 and the machine control unit 106, optimizing train movement and/or training, incident investigations, alerting, enforce safe stops, etc.

By understanding the location of the operator control unit 104, the machine control unit 106 may improve performance, make better decisions, etc. For example, with integration to a CattronConnect™ rail control system, a LairdLink™ rail control system, a Rail Insight™ rail control system, RemoteIQ™ cloud-based remote monitoring and control, etc. many new features may be available. An improvement in safety may occur by providing the ability to know where the operator 108 is located if the operator control unit 104 enters a tilt timeout state (e.g., indicating the possibility that the operator 108 has fallen, etc.). An improvement in safety may also occur by monitoring and comparing the for monitoring and comparing the geographic location of the operator control unit to predefined hazardous walking condition locations to determine whether and when the operator control unit will enter a hazardous walking condition location. Prior to entry of the operator control unit into the hazardous walking condition location, a warning alert may be provided and/or a safe stop may be triggered and enforced.

Knowing a location of the operator 108 may improve RF communication troubleshooting. From an operations standpoint, knowing the location of the operator 108 could improve train movement optimization, be used for training purposes, etc. During incident investigations, having a record of the location of the operator control unit 104 (and therefore the operator 108) could help in both investigation interpretation and in verification of an operator submitted incident description.

FIG. 1 illustrates a locomotive 102, an operator 108, and an operator control unit 104 in two-way communication with a machine control unit 106. In other embodiments, the system 100 may include more than one locomotive 102, one or more train cars, more than one operator 108 and operator control unit 104, more than one machine control unit 106, an operator control unit in one-way communication with a machine control unit, etc.

FIG. 2 illustrates a block diagram of the operator control unit 104 as shown in FIG. 1. The operator control unit 104 includes a user interface 210 for receiving input (e.g., commands, etc.) from an operator. The user interface may include a display 212, which may include any suitable display (e.g., a liquid crystal display (LCD), light emitting diodes (LED), indicator lights, etc.). In some embodiments, the operator control unit may include an audible, etc. alert device to notify the operator of one or more different conditions, e.g., an approaching hazardous walking condition location, etc. The user interface may include an input 214, which may include any suitable input (e.g., a keypad, touchscreen, switches, etc.). In other embodiments, the operator control unit 104 may not include a display 212 or an input 214.

The operator control unit also includes a receiver 218, which is configured to receive signals to determine a location of the operator control unit 104. In other embodiments, other suitable devices capable of determining a location of the operator control unit 104 may be used. For example, the receiver 218 may include a global navigation satellite system (GNSS) receiver, a real-time locating system (RTLS) receiver or transceiver, etc.

The operator control unit 104 also includes a wireless antenna 216. As described above, the wireless antenna 216 may communicate with a machine control unit of a locomotive via two-way communication using any suitable wireless communication protocol (e.g., RF, WiFi, LTE, Bluetooth, a short-range wireless communication protocol, etc.).

In some embodiments, the operator control unit 104 may include multiple wireless radios (e.g., antennas, etc.), where one wireless radio transmits command data and another wireless radio transmits location data. Alternatively, or in addition, the wireless antenna 216 may automatically multiplex and change between different radio frequency (RF) channels when transmitting the command data and the location data to the machine control unit 106.

According to an example embodiment, an operator control unit device generally includes a user interface configured to receive one or more commands from an operator for controlling a locomotive. The operator control unit also includes a receiver (e.g., global positioning system (GPS) receiver, etc.) configured to receive geographical location information of the operator control unit, and a wireless communication device. The wireless communication device is configured to transmit command data corresponding to the one or more commands and location data corresponding to the geographical location information of the operator control unit to a machine control unit on the locomotive, which may allow the machine control unit positioned on the locomotive to determine a geographical location. The machine control unit, operator control unit, or other equipment or system component may monitor and compare the geographic location of the operator control unit to one or more predefined hazardous walking condition locations to determine whether and when the operator control unit will enter a predefined hazardous walking condition location. Prior to entry of the operator control unit into a predefined hazardous walking condition location, a warning alert may be provided and/or a safe stop may be triggered and enforced.

According to another example embodiment, an exemplary method of monitoring location of an operator control unit corresponding to a locomotive is disclosed. The exemplary method generally includes receiving a command from an operator control unit associated with an operator. The command is related to controlling a locomotive. The method also includes retrieving a geographical location of the operator control unit and transmitting a command data message corresponding to the command and a location data message corresponding to the geographical location of the operator control unit to a machine control unit on the locomotive. The method may also include monitoring and comparing (e.g., by the machine control unit, operator control unit, other equipment, or system component, etc.) the geographic location of the operator control unit to one or more predefined hazardous walking condition locations to determine whether and when the operator control unit will enter a predefined hazardous walking condition location. The method may further include prior to entry of the operator control unit into a predefined hazardous walking condition location, providing a warning alert and/or triggering and enforcing a safe stop.

Transmitting may include transmitting the command data message and the location data message to the machine control unit via a radio frequency (RF) channel. In some embodiments, the command data message and location data message may be sent via the same RF channel (e.g., in separate packets, in different time slots, etc.).

Transmitting may include transmitting the location data message instead of the command data message when the command data message is the same for a period of time, only after the command data message has remained stable for a time period sufficient for the machine control unit to receive the command data message, etc. Accordingly, in some embodiments, location data messages may only be sent when they will not interfere with command data messages being successfully transmitted to the machine control unit.

The location data message may include relative positional data and/or absolute positional data. For example, absolute positional data may be transmitted first from the OCU to the MCU, and relative positional data may be sent in a later transmission indicating a change in position of the OCU relative to the previously sent absolute positional data. The relative position data may have a smaller size than the absolute position data, such that the relative position data can be transmitted more easily (e.g., with less bandwidth, less packets, in a shorter transmission, etc.). In some embodiments, transmitting the location data may include segmenting the location data message into multiple RF packets to be reassembled by the machine control unit.

According to another example embodiment, an operator control unit includes a user interface configured to receive one or more commands from an operator for controlling a locomotive, a receiver configured to receive geographical location information of the operator control unit, and a wireless communication device.

The wireless communication device is configured to transmit location data corresponding to the geographical location information to a remote station separate from the locomotive for collecting the location data of the operator control unit, and to transmit command data corresponding to the one or more commands to the machine control unit on the locomotive directly or via the remote station. The remote station, operator control unit, other RCL equipment or system component(s), etc. may be configured to monitor and compare the geographic location of the operator control unit to one or more predefined hazardous walking condition locations to determine whether and when the operator control unit will enter a predefined hazardous walking condition location and to provide a warning alert and/or triggering and enforcing a safe stop prior to entry of the operator control unit into the predefined hazardous walking condition location.

For example, the wireless communication device may include a first wireless radio configured to transmit the command data to the machine control unit, and a second wireless radio configured to transmit the location data to the remote station.

Alternatively, or in addition, and the operator control unit could be configured to transmit both the location data and the command data to the remote station to facilitate the remote station processing the location data while passing only the command data to the machine control unit on the locomotive.

For example, the remote station (e.g., command center, etc.) may include a radio infrastructure, a receiver, etc. This device may be located separately from any locomotives and may exist to aggregate OCU location data (e.g., from multiple different operator control units, etc.). The remote station device may skim location data packets while forwarding only command data packets to the machine control unit on the locomotive.

Some embodiments may provide one or more advantages including transmission of location data of an operator control unit via a same RF channel as existing command data, avoiding the need to add an additional RF communication channel, saved costs, increased safety for knowing the location of an operator in case of a fall, accident, or hazardous walking condition location, increased train movement optimization, increased training, incident investigation support, hazardous walking condition alerting, enforce safe stops, etc.

In an exemplary embodiment, the wireless communication device of an operator control unit is configured to transmit command data and location data to a machine control unit via an existing Wi-Fi network. Advantageously, the transmission of the command data and the location data to the machine control unit via the existing Wi-Fi network avoids the need to add an additional wireless network channel.

In an exemplary embodiment, the wireless communication device of an operator control unit is configured to automatically multiplex and change between different radio frequency (RF) channels when transmitting command data and location data to a machine control unit. In this exemplary embodiment, the wireless communication device is configured to transmit the command data to the machine control unit via a first existing RF channel of the different existing RF channels, and to transmit the location data to the machine control unit via a second existing RF channel of the different existing RF channels. Advantageously, the transmission of the command data and the location data to the machine control unit via the first and second existing RF channels, respectively, avoids the need to add an additional RF channel.

In an exemplary embodiment, a method includes receiving geographical location information of an operator control unit configured to receive one or more commands from an operator for controlling a locomotive, and monitoring and comparing a geographical location of the operator control unit to one or more predefined hazardous walking condition locations. The method also includes: prior to entry of the operator control unit into a hazardous walking condition location, providing an alert of an approaching hazardous walking condition location, and/or triggering and/or enforcing a safe stop of the locomotive.

In an exemplary embodiment, a non-transitory computer-readable storage media includes executable instructions, which when executed by at least one processor, cause a system to be operable to: monitor and compare a geographical location of an operator control unit to one or more predefined hazardous walking condition locations; and prior to entry of the operator control unit into a hazardous walking condition location: provide an alert of an approaching hazardous walking condition location; and/or trigger and/or enforce a safe stop of a locomotive.

In exemplary embodiments, a system includes an operator control unit configured to receive one or more commands from an operator for controlling a locomotive. The operator control unit includes a receiver configured to receive geographical location information of the operator control unit. The system is configured to: monitor a geographical location of the operator control unit; and dynamically track and update one or more identified hazardous walking condition locations for use by the system when monitoring proximity of the geographical location of the operator control unit relative to the one or more identified hazardous walking condition locations.

In exemplary embodiments, the system is configured to dynamically update an electronic geofence map including one or more geofences defining the one or more identified hazardous walking condition locations. The system may include a machine control unit onboard the locomotive. The machine control unit may be configured to transmit the electronic geofence map from the machine control unit to the operator control unit, such as when the operator control unit is paired to the machine control unit, etc. This may enable the operator control unit to be operable for determining, locally and/or independently of the machine control unit, when the geographical location of the operator control unit indicates that the operator control unit is approaching a geofence that defines a hazardous walking condition location.

In exemplary embodiments, the system is configured to dynamically track and update the one or more identified hazardous walking condition locations for use by the system in determining when the operator control unit is approaching a hazardous walking condition location prior to entry of the operator control unit into the hazardous walking condition location. This may enable the system to be operable for providing an alert of the approaching hazardous walking condition location and/or for triggering and/or enforcing a safe stop of the locomotive. The system may be configured to determine severity of an approaching hazardous walking condition location via a local monitoring server through an RF gateway, whereby the severity of the approaching hazardous walking condition may then be usable by the system when determining whether to provide the alert and/or to trigger and/or enforce the safe stop of the locomotive.

In exemplary embodiments, the system is configured to dynamically track and update the one or more identified hazardous walking condition locations including a location(s) at which are present one or more ground conditions that could be hazardous to an operator when deboarding the locomotive in a low visibility environment. This may enable the system to be operable for alerting the operator before deboarding the locomotive at the location(s).

In exemplary embodiments, the system is configured to dynamically track and update the one or more identified hazardous walking condition locations including a location(s) at which are present one or more hazardous weather conditions. This may enable the system to be operable for alerting an operator of the one or more hazardous weather conditions. The system may be configured to obtain the one or more hazardous weather conditions via a communication link with a weather reporting service and/or a local weather alert(s) provided by a railroad dispatcher.

In exemplary embodiments, the system may be configured to dynamically track and update the one or more identified hazardous walking condition locations automatically without manual input from an operator. The system may be configured to dynamically track and update one or more stationary obstacles and/or one or more rolling stock in a rail yard.

In exemplary embodiments, the operable control unit is configured to transmit command data corresponding to the one or more commands and location data corresponding to the geographical location information of the operator control unit to a machine control unit onboard the locomotive.

In exemplary embodiments, the machine control unit may be configured to: determine, via the location data, the geographical location of the operator control unit; dynamically track and update the one or more identified hazardous walking condition locations; and monitor proximity of the geographical location of the operator control unit relative to the one or more identified hazardous walking condition locations.

In exemplary embodiments, the operator control unit may be configured to automatically multiplex and change between different radio frequency (RF) channels when transmitting the command data and the location data to the machine control unit. The operator control unit is configured to transmit the command data to the machine control unit via a first RF channel of the different RF channels, and to transmit the location data to the machine control unit via a second RF channel of the different RF channels.

In exemplary embodiments, the operator control unit may be configured to transmit the command data and the location data to the machine control unit via a Wi-Fi network and/or LTE network. The one or more identified hazardous walking condition locations may be stored within memory of the machine control unit and/or within memory of the operator control unit.

In exemplary embodiments, the operator control unit may be configured to transmit a location data message instead of a same command data message of the command data only after the same command data message has been repeated more than a predetermined number of times in succession.

In exemplary embodiments, the operator control unit may be configured to transmit the location data to the machine control unit only after command data messages have remained stable for a time period sufficient for the machine control unit to receive the command data.

In exemplary embodiments, the operator control unit may be configured to continue transmitting the command data to the machine control unit until an acknowledgment is received from the machine control unit indicating the last command data message was received, and to transition to transmitting the location data to the machine control unit only after the acknowledgment is received from the machine control unit indicating the last command data message was received.

In exemplary embodiments, the operator control unit may be configured to break up the location data into multiple RF packets that are transmitted separately between existing command data messages. The machine control unit may be configured to receive the multiple RF packets between the existing command data messages and reassemble the multiple RF packets to determine a location of the operator control unit.

In exemplary embodiments, the receiver may include a global positioning system (GPS) receiver, a global navigation satellite system (GNSS) receiver, and/or a real-time locating system (RTLS) receiver or transceiver configured to receive the geographical location information of the operator control unit. The geographical location information of the operator control unit may include absolute positional data for the geographical location of the operator control unit. The geographical location information of the operator control unit may further include relative positional data for the geographical location of the operator control unit. The relative positional data may be indicative of a change in geographical position of the operator control unit relative to a prior absolute positional data message. The relative positional data includes less bytes of data than the absolute positional data. The operator control unit may include a first wireless radio configured to transmit command data corresponding to the one or more commands to a machine control unit on the locomotive; and a second wireless radio configured to transmit location data corresponding to the geographical location information of the operator control unit to the machine control unit on the locomotive to allow the machine control unit positioned on the locomotive to determine a geographical location of the operator control unit.

In exemplary embodiments, the operator control unit may include a wireless communication device configured to transmit location data corresponding to the geographical location information of the operator control unit to a remote station separate from the locomotive for collecting the location data of the operator control unit, and to transmit command data corresponding to the one or more commands to a machine control unit on the locomotive directly via a wireless network channel or via the remote station. The wireless communication device may include a first wireless radio configured to transmit the command data to the machine control unit directly via the wireless network channel, and a second wireless radio configured to transmit the location data to the remote station. The remote station may include a radio infrastructure or a repeater. The operator control unit may be configured to transmit both the location data and the command data to the remote station to facilitate the remote station processing the location data while passing only the command data to the machine control unit on the locomotive.

In exemplary embodiments, the operator control unit may include a wireless communication device configured to transmit, via a same radio frequency (RF) channel, command data corresponding to the one or more commands and location data corresponding to the geographical location information of the operator control unit to a machine control unit onboard the locomotive.

In exemplary embodiments, a system comprises a device including a receiver configured to receive geographical location information of the device. The system is configured to: monitor a geographical location of the device; and dynamically update an electronic geofence map including one or more geofences defining one or more identified hazardous condition locations, the electronic geofence map usable by the system when monitoring proximity of the geographical location of the device relative to the one or more identified hazardous condition locations.

In exemplary embodiments, the device comprises an operator control unit configured to receive one or more commands from an operator for controlling a locomotive.

In exemplary embodiments, the system includes a machine control unit onboard the locomotive. The machine control unit is configured to transmit the electronic geofence map from the machine control unit to the operator control unit, such as when the operator control unit is paired to the machine control unit, etc. This may enable the operator control unit to be operable for determining, locally and/or independently of the machine control unit, when the geographical location of the operator control unit indicates that the operator control unit is approaching a geofence that defines a hazardous condition location.

In exemplary embodiments, a method includes receiving geographical location information of an operator control unit configured to receive one or more commands from an operator for controlling a locomotive; monitoring a geographical location of the operator control unit; and dynamically tracking and updating one or more identified hazardous walking condition locations for use when monitoring proximity of the geographical location of the operator control unit relative to the one or more identified hazardous walking condition locations.

In exemplary embodiments, a non-transitory computer-readable storage media includes executable instructions, which when executed by at least one processor, cause a system to be operable to: monitor a geographical location of an operator control unit, the operator control unit configured to receive one or more commands from an operator for controlling a locomotive; and to dynamically track and update one or more identified hazardous walking condition locations, for use when monitoring proximity of the geographical location of the operator control unit relative to the one or more identified hazardous walking condition locations.

Embodiments of the disclosure may be implemented using computer programming or engineering techniques including computer software, firmware, hardware, or any combination or subset thereof. For example, a technical effect of utilizing OCU location data to enhance operator safety in hazardous walking condition locations may be achieved by performing the following operations: receiving geographical location information of an operator control unit configured to receive one or more commands from an operator for controlling a locomotive; monitoring and comparing a geographical location of the operator control unit to one or more predefined hazardous walking condition locations; and prior to entry of the operator control unit into a hazardous walking condition location: providing an alert of an approaching hazardous walking condition location; and/or triggering and/or enforcing a safe stop of the locomotive.

Exemplary embodiments may include one or more processors and memory coupled to (and in communication with) the one or more processors. A processor may include one or more processing units (e.g., in a multi-core configuration, etc.) such as, and without limitation, a central processing unit (CPU), a microcontroller, a reduced instruction set computer (RISC) processor, an application specific integrated circuit (ASIC), a programmable logic device (PLD), a gate array, and/or any other circuit or processor capable of the functions described herein.

It should be appreciated that the functions described herein, in some embodiments, may be described in computer executable instructions stored on a computer readable media, and executable by at least one processor. The computer readable media is a non-transitory computer readable storage medium. By way of example, and not limitation, such computer-readable media can include dynamic random access memory (DRAM), static random access memory (SRAM), read only memory (ROM), erasable programmable read only memory (EPROM), solid state devices, flash drives, CD-ROMs, thumb drives, floppy disks, tapes, hard disks, other optical disk storage, magnetic disk storage or other magnetic storage devices, any other type of volatile or nonvolatile physical or tangible computer-readable media, or other medium that can be used to carry or store desired program code in the form of instructions or data structures and that can be accessed by a computer. Combinations of the above should also be included within the scope of computer-readable media.

Computer-executable instructions may be stored in the memory for execution by a processor to particularly cause the processor to perform one or more of the functions described herein, such that the memory is a physical, tangible, and non-transitory computer readable storage media. Such instructions often improve the efficiencies and/or performance of the processor that is performing one or more of the various operations herein. It should be appreciated that the memory may include a variety of different memories, each implemented in one or more of the functions or processes described herein.

It should also be appreciated that one or more aspects of the present disclosure transform a general-purpose computing device into a special-purpose computing device when configured to perform the functions, methods, and/or processes described herein.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising an operator control unit configured to receive one or more commands from an operator for controlling a locomotive, the operator control unit including a receiver configured to receive geographical location information of the operator control unit, wherein the system is configured to:

monitor a geographical location of the operator control unit; and dynamically track and update one or more identified hazardous walking condition locations for use by the system when monitoring proximity of the geographical location of the operator control unit relative to the one or more identified hazardous walking condition locations;

wherein the system is configured to dynamically update an electronic geofence map including one or more geofences defining the one or more identified hazardous walking condition locations.

2. The system of claim 1, wherein the system includes a machine control unit onboard the locomotive, the machine control unit configured to transmit the electronic geofence map from the machine control unit to the operator control unit when the operator control unit is paired to the machine control unit.

3. The system of claim 1, wherein the system includes a machine control unit onboard the locomotive, the machine control unit configured to transmit the electronic geofence map from the machine control unit to the operator control unit, thereby enabling the operator control unit to be operable for determining, locally and/or independently of the machine control unit, when the geographical location of the operator control unit indicates that the operator control unit is approaching a geofence that defines a hazardous walking condition location.

4. The system of claim 1, wherein the system is configured to dynamically track and update the one or more identified hazardous walking condition locations for use by the system in determining when the operator control unit is approaching a hazardous walking condition location prior to entry of the operator control unit into the hazardous walking condition location.

5. The system of claim 1, wherein the system is configured to dynamically track and update the one or more identified hazardous walking condition locations for use by the system in determining when the operator control unit is approaching a hazardous walking condition location prior to entry of the operator control unit into the hazardous walking condition location, thereby enabling the system to be operable for providing an alert of the hazardous walking condition location and/or for triggering and/or enforcing a safe stop of the locomotive.

6. The system of claim 5, wherein the system is configured to determine severity of an approaching hazardous walking condition location via a local monitoring server through an RF gateway, whereby the severity of the approaching hazardous walking condition is usable by the system when determining whether to provide the alert and/or to trigger and/or enforce the safe stop of the locomotive.

7. The system of claim 1, wherein:

the system is configured to dynamically track and update the one or more identified hazardous walking condition locations automatically without manual input from an operator; and the system is configured to dynamically track and update one or more stationary obstacles and/or one or more rolling stock in a rail yard.

8. The system of claim 1, wherein the operator control unit is configured to transmit command data corresponding to the one or more commands and location data corresponding to the geographical location information of the operator control unit to a machine control unit onboard the locomotive.

9. The system of claim 8, wherein the machine control unit is configured to:

determine, via the location data, the geographical location of the operator control unit;

dynamically track and update the one or more identified hazardous walking condition locations; and monitor proximity of the geographical location of the operator control unit relative to the one or more identified hazardous walking condition locations.

10. The system of claim 8, wherein:

the operator control unit is configured to automatically multiplex and change between different radio frequency (RF) channels when transmitting the command data and the location data to the machine control unit; and the operator control unit is configured to transmit the command data to the machine control unit via a first RF channel of the different RF channels, and to transmit the location data to the machine control unit via a second RF channel of the different RF channels.

11. The system of claim 8, wherein:

the operator control unit is configured to transmit the command data and the location data to the machine control unit via a Wi-Fi network and/or LTE network; and/or the one or more identified hazardous walking condition locations are stored within memory of the machine control unit and/or within memory of the operator control unit.

12. The system of claim 8, wherein the operator control unit is configured to transmit a location data message instead of a same command data message of the command data only after the same command data message has been repeated more than a predetermined number of times in succession.

13. The system of claim 8, wherein the operator control unit is configured to transmit the location data to the machine control unit only after command data messages have remained stable for a time period sufficient for the machine control unit to receive the command data.

14. The system of claim 8, wherein the operator control unit is configured to continue transmitting the command data to the machine control unit until an acknowledgement is received from the machine control unit indicating the last command data message was received, and to transition to transmitting the location data to the machine control unit only after the acknowledgement is received from the machine control unit indicating the last command data message was received.

15. The system of claim 8, wherein:

the operator control unit is configured to break up the location data into multiple RF packets that are transmitted separately between existing command data messages; and the machine control unit is configured to receive the multiple RF packets between the existing command data messages and reassemble the multiple RF packets to determine a location of the operator control unit.

16. The system of claim 1, wherein:

the receiver includes a global positioning system (GPS) receiver, a global navigation satellite system (GNSS) receiver, and/or a real-time locating system (RTLS) receiver or transceiver configured to receive the geographical location information of the operator control unit; and/or the geographical location information of the operator control unit includes absolute positional data for the geographical location of the operator control unit, and the geographical location information of the operator control unit further includes relative positional data for the geographical location of the operator control unit, the relative positional data is indicative of a change in geographical position of the operator control unit relative to a prior absolute positional data message, and the relative positional data includes less bytes of data than the absolute positional data; and/or the operator control unit includes a first wireless radio configured to transmit command data corresponding to the one or more commands to a machine control unit on the locomotive; and a second wireless radio configured to transmit location data corresponding to the geographical location information of the operator control unit to the machine control unit on the locomotive to allow the machine control unit positioned on the locomotive to determine a geographical location of the operator control unit.

17. The system of claim 1, wherein the operator control unit includes a wireless communication device configured to transmit location data corresponding to the geographical location information of the operator control unit to a remote station separate from the locomotive for collecting the location data of the operator control unit, and to transmit command data corresponding to the one or more commands to a machine control unit on the locomotive directly via a wireless network channel or via the remote station.

18. The system of claim 17, wherein:

the wireless communication device includes a first wireless radio configured to transmit the command data to the machine control unit directly via the wireless network channel, and a second wireless radio configured to transmit the location data to the remote station; and/or the remote station includes a radio infrastructure or a repeater, and the operator control unit is configured to transmit both the location data and the command data to the remote station to facilitate the remote station processing the location data while passing only the command data to the machine control unit on the locomotive.

19. A system comprising an operator control unit configured to receive one or more commands from an operator for controlling a locomotive, the operator control unit including a receiver configured to receive geographical location information of the operator control unit, wherein the system is configured to:

monitor a geographical location of the operator control unit; and dynamically track and update one or more identified hazardous walking condition locations for use by the system when monitoring proximity of the geographical location of the operator control unit relative to the one or more identified hazardous walking condition locations;

wherein the system is configured to dynamically track and update the one or more identified hazardous walking condition locations including a location(s) at which are present one or more ground conditions that could be hazardous to an operator when deboarding the locomotive in a low visibility environment, thereby enabling the system to be operable for alerting the operator before deboarding the locomotive at the location(s).

20. The system of claim 19, wherein the system is configured to dynamically update an electronic geofence map including one or more geofences defining the one or more identified hazardous walking condition locations.

21. A system comprising an operator control unit configured to receive one or more commands from an operator for controlling a locomotive, the operator control unit including a receiver configured to receive geographical location information of the operator control unit, wherein the system is configured to:

monitor a geographical location of the operator control unit; and dynamically track and update one or more identified hazardous walking condition locations for use by the system when monitoring proximity of the geographical location of the operator control unit relative to the one or more identified hazardous walking condition locations;

wherein the system is configured to dynamically track and update the one or more identified hazardous walking condition locations including a location(s) at which are present one or more hazardous weather conditions, thereby enabling the system to be operable for alerting an operator of the one or more hazardous weather conditions.

22. The system of claim 21, wherein the system is configured to obtain the one or more hazardous weather conditions via a communication link with a weather reporting service and/or a local weather alert(s) provided by a railroad dispatcher.

23. A system comprising an operator control unit configured to receive one or more commands from an operator for controlling a locomotive, the operator control unit including a receiver configured to receive geographical location information of the operator control unit, wherein the system is configured to:

monitor a geographical location of the operator control unit; and dynamically track and update one or more identified hazardous walking condition locations for use by the system when monitoring proximity of the geographical location of the operator control unit relative to the one or more identified hazardous walking condition locations;

wherein the operator control unit includes a wireless communication device configured to transmit, via a same radio frequency (RF) channel, command data corresponding to the one or more commands and location data corresponding to the geographical location information of the operator control unit to a machine control unit onboard the locomotive.

24. A system comprising a device including a receiver configured to receive geographical location information of the device, wherein the system is configured to:

monitor a geographical location of the device; and dynamically update an electronic geofence map including one or more geofences defining one or more identified hazardous condition locations, the electronic geofence map usable by the system when monitoring proximity of the geographical location of the device relative to the one or more identified hazardous condition locations.

25. The system of claim 24, wherein the device comprises an operator control unit configured to receive one or more commands from an operator for controlling a locomotive.

26. The system of claim 25, wherein the system includes a machine control unit onboard the locomotive, the machine control unit configured to transmit the electronic geofence map from the machine control unit to the operator control unit, thereby enabling the operator control unit to be operable for determining, locally and/or independently of the machine control unit, when the geographical location of the operator control unit indicates that the operator control unit is approaching a geofence that defines a hazardous condition location.

27. The system of claim 25, wherein the system includes a machine control unit onboard the locomotive, the machine control unit configured to transmit the electronic geofence map from the machine control unit to the operator control unit when the operator control unit is paired to the machine control unit.

* * * * *